US005242167A

United States Patent [19]

Antonious

[11] Patent Number: 5,242,167

[45] **Date of Patent: * Sep. 7, 1993**

[54] PERIMETER WEIGHTED IRON TYPE CLUB HEAD WITH CENTRALLY LOCATED GEOMETRICALLY SHAPED WEIGHT

[76] Inventor: Anthony J. Antonious, 7738 Calle Facil, Sarasota, Fla. 34238

[ * ] Notice: The portion of the term of this patent subsequent to Mar. 13, 2007 has been disclaimed.

[21] Appl. No.: 931,433

[22] Filed: Aug. 18, 1992

Related U.S. Application Data

[63] Continuation of Ser. No. 587,749, Sep. 25, 1990, abandoned.

[51] Int. Cl.[5] ..... A63B 53/04

[52] U.S. Cl. ..... 273/167 F; 273/167 H; 273/169

[58] Field of Search ..... 273/167 R-177 A, 273/164.1, 187.4, 186.2, 193 R, 194 R, 194 A, 194 B; D21/214, 215, 219, 220

[56] References Cited

U.S. PATENT DOCUMENTS

| | | | |
|---|---|---|---|
| D. 104,495 | 5/1937 | Gallagher | 273/164 |
| D. 244,703 | 6/1977 | Guzzle et al. | 273/169 X |
| D. 256,264 | 8/1980 | Solheim | D21/220 |
| 1,320,163 | 10/1919 | Maurice | 273/171 |
| 2,846,228 | 8/1958 | Reach | 273/170 X |
| 3,722,887 | 3/1973 | Cochran et al. | 273/77 A |
| 3,749,408 | 7/1973 | Mills | 273/171 |
| 3,814,437 | 6/1974 | Winquist | 273/167 R |
| 4,325,553 | 4/1982 | Taylor | 273/167 F |
| 4,326,326 | 4/1982 | MacDonald | 273/167 F X |
| 4,852,880 | 8/1989 | Kobayashi | 273/169 |
| 4,907,806 | 3/1990 | Antonious | 273/164 |
| 4,915,386 | 4/1990 | Antonious | 273/167 F |
| 4,955,610 | 9/1990 | Creighton et al. | 273/169 |
| 4,957,294 | 9/1990 | Long | 273/169 |

OTHER PUBLICATIONS

Golf Digest, Magazine, Article for "Butch Baird's Irons", Jan. 1979, p. 117.

*Primary Examiner*—V. Millin
*Assistant Examiner*—Sebastiano Passaniti
*Attorney, Agent, or Firm*—Finnegan, Henderson, Farabow, Garrett & Dunner

[57] ABSTRACT

A perimeter weighted iron type golf club head having a recess or cavity back and peripheral mass with an improved weight configuration formed of a raised geometric shaped mass weight member within the cavity spaced from the peripheral mass and located at the center of percussion of the golf club head.

14 Claims, 3 Drawing Sheets

PERIMETER WEIGHTED IRON TYPE CLUB HEAD WITH CENTRALLY LOCATED GEOMETRICALLY SHAPED WEIGHT

This application is a continuation of application Ser. No. 587,749, filed Sep. 25, 1990, now abandoned.

BACKGROUND OF THE INVENTION

The present invention relates to perimeter weighted golf club heads, and more particularly to recessed or cavity back, iron type perimeter weighted golf club heads having an improved weight distribution configuration. Perimeter weighted golf club heads represent attempts to maximize weight distribution adjacent the outer periphery of a club head to maximize energy transfer to a golf ball which is struck off of the center of percussion (CP). To this end, the peripheral weighted club heads are formed with a peripheral mass located around the rear perimeter of the club head which forms a recess or cavity on the back of the club head. Whereas these club head designs work quite well when a ball is miss-hit off of the center of percussion (CP), there is often a lack of sufficient energy transfer to a ball which is struck precisely on the center of percussion (CP) because of the lack of weight in that area. This results in a loss of feel and/or control of these type of shots.

In my prior U.S. Pat. No. 4,915,386, I have provided a perimeter weighted golf club head having a rounded concentric weight member centrally located behind the center of percussion (CP) and formed completely within the cavity and spaced from the cavity side walls formed by the peripheral mass on the club head.

SUMMARY OF THE INVENTION

The present invention provides an improved golf club head having the advantages of peripheral weighted club heads and which also enhances the shot making ability of the club head when a ball is struck at the precise center of percussion (CP). Like the aforementioned U.S. Pat. No. 4,915,386, the present invention provides a mass directly behind the center of percussion (CP) and spaced from the peripheral mass within the cavity on the rear of the club head. The centrally located solid mass uses any one of a number of geometric shapes which are positioned directly behind the center of percussion (CP) and raised from the rear surface of the club head within the cavity. Such shapes include, but are not limited to squares, triangles, diamonds, trapezoids, parallelograms, semi-circles and a number of other polygon shaped elements. Like the aforementioned patent, the structure provides a more solid feel when a golf ball is struck directly at the center of percussion (CP) because of the additional weight located at that point, thereby producing improved feel and greater accuracy resulting in a golf ball's traveling further and straighter for a given energy transfer provided by a specific golf swing.

Among the objects of the present invention are to provide a peripheral weighted golf club head which permits a golfer to achieve improved feel, control, accuracy and optimum distance when a golf ball is struck by the club head at the precise center of percussion (CP).

These and other objects will become apparent with reference to the accompanying drawings and following specification which illustrate the embodiments of the invention.

DESCRIPTION OF THE PREFERRED EMBODIMENTS

Figure 1:
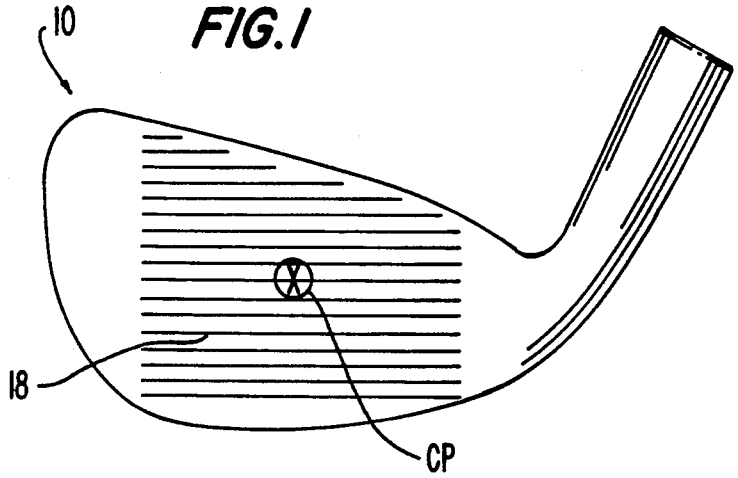
FIG. 1 is a front elevational view of a golf club head in accordance with the present invention.

Referring to the drawings, the preferred embodiments of the present invention are illustrated. Wherever possible, the same or like reference numerals are used throughout the drawings to refer to same or like parts.

Figure 2:
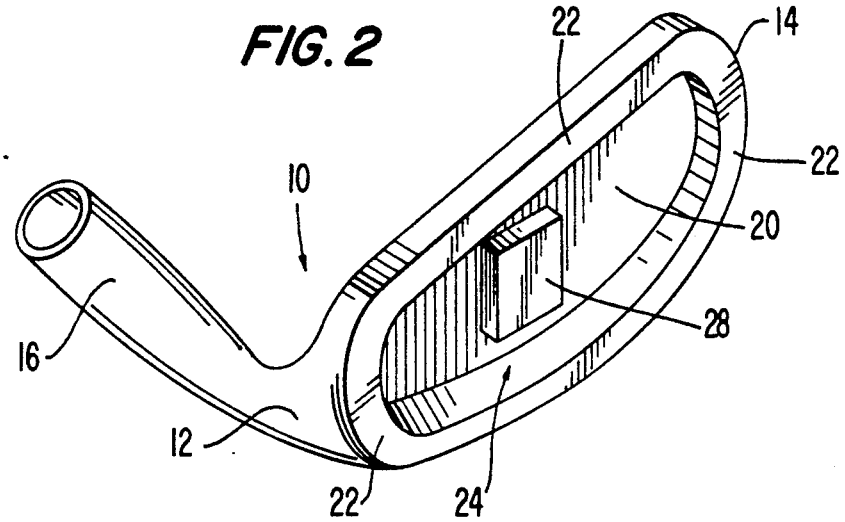
FIG. 2 is a rear elevational view of the golf club head of FIG. 1.

FIGS. 1 and 2 illustrate a first embodiment of a golf club head 10 of the present invention. The club head 10 is a conventional, peripheral weighted iron type club head including a heel 12, toe 14, hosel 16 and ball striking face 18 having a loft angle of at least 12 degrees and a complementary rear face 20. The club head includes a center of percussion shown on the ball striking face 18 which is located at approximately the center of the club head, the exact position being precisely controlled by the weight distribution of the club head itself. The center of percussion (CP) represents the spot at which a golf ball would be struck to provide maximum energy transfer to the ball by the club head thereby producing golf shots which provide not only maximum distance but a more precise control producing a tighter pattern at the ultimate location where the golf ball comes to rest. The club head includes a peripheral mass 22 formed around the perimeter of the club head 10 which, in combination with the rear face 20, forms a cavity 24. A geometrically shaped mass 28 in the form of a raised square is positioned on the rear face 20 directly behind the center of percussion (CP) and located directly within the center of the cavity and spaced from the peripheral mass 22. The geometrically shaped mass 28 extends rearwardly from the rear face 20.

By regulating the overall weight distribution of the club head, the normal weight parameters of these type of iron type club heads can be maintained. However, by locating the geometrical mass directly behind the center of percussion (CP), the efficiency of the energy transfer from the club head to the golf ball is increased because of the additional weight directly behind the center of percussion (CP) when the ball is hit directly on the center of percussion (CP). If the golf ball is struck off of the center of percussion (CP) and closer to the peripheral mass 22, there is still greater energy available to produce more acceptable golf shots.

Figure 3:
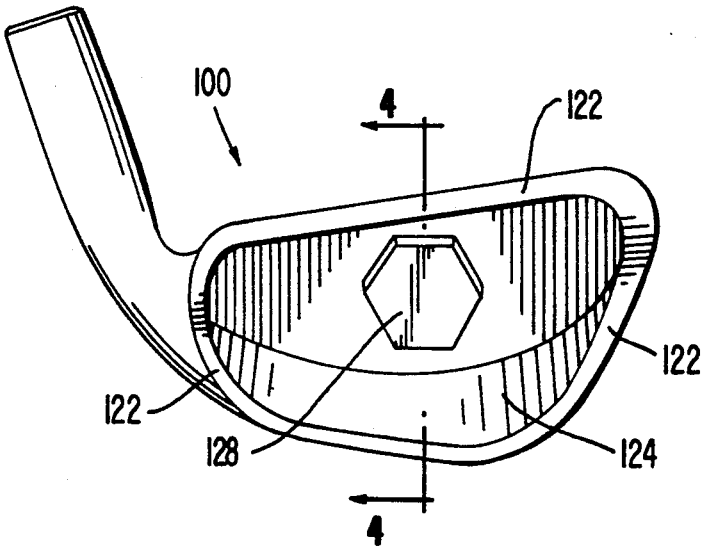
FIG. 3 is a rear elevational view of a second embodiment of the club head of the present invention.
Figure 4:
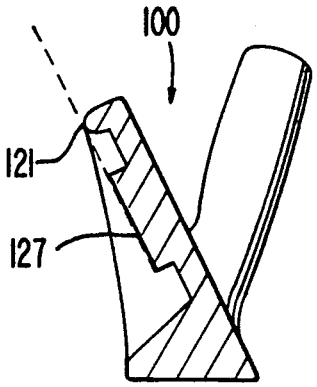
FIG. 4 is an end sectional view taken along the lines 4—4 of FIG. 3.

FIGS. 3 and 4 illustrate a second embodiment of a golf club head 100 of the present invention which is essentially identical to the embodiment shown in FIGS. 1 and 2 except that the geometric weight member 128 takes the shape of a raised octagon. See FIG. 4 which shows the weight member 128 spaced from the peripheral mass 122 and located within the cavity 124 in the same manner as described with respect to the embodiment of FIG. 1. As shown in FIG. 4, the rear raised surface 127 of weight member 128 extends rearwardly from the rear face of the club head to at least substantial alignment with the rearmost surface 121 of the upper surface portion of the peripheral mass 122 of the club head. It will be appreciated that the various size and shapes of the geometrical members which form the mass within the cavity allow the weight to be precisely distributed and located, thereby enabling a golfer to experiment to find a club head construction which maximizes the energy transfer developed by his own particular swing.

Figure 5:
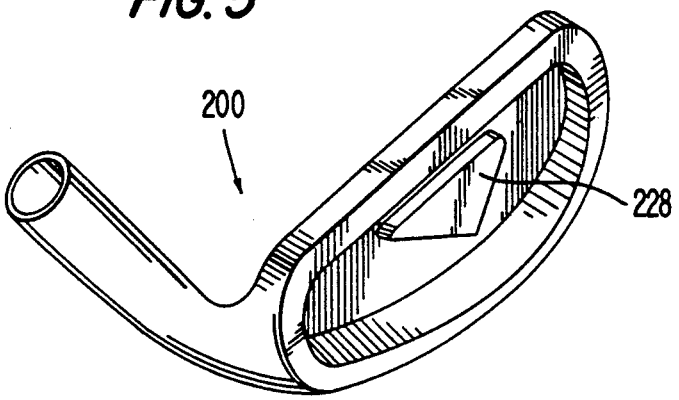
FIG. 5 is a rear perspective view of a third embodiment of the golf club head of the present invention.

FIG. 5 illustrates a third embodiment of a golf club head 200 of the present invention in which the geometrically shaped mass 228 is triangular in shape.

Figure 6:
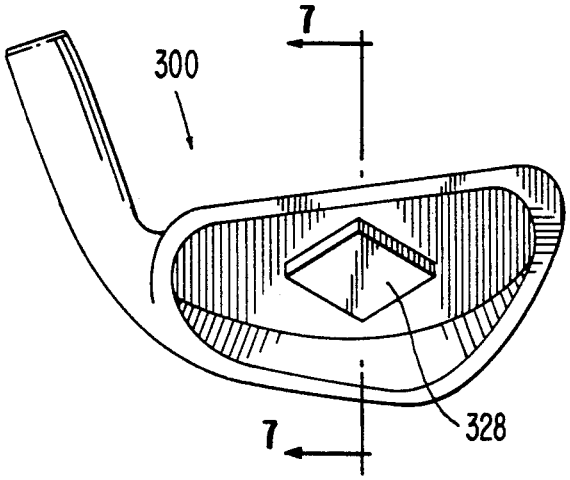
FIG. 6 is a rear elevational view of a fourth embodiment of the golf club head of the present invention.
Figure 7:
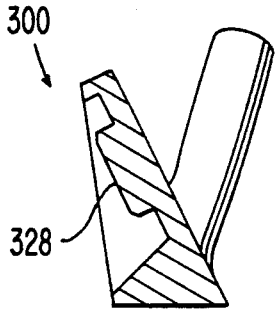
FIG. 7 is an end elevational view taken along the lines 7—7 of FIG. 6.

FIGS. 6 and 7 illustrate a fourth embodiment of a golf club head 300 of the present invention wherein the mass 328 within the cavity and directly behind the center of percussion (CP) is diamond shaped.

Figure 8:
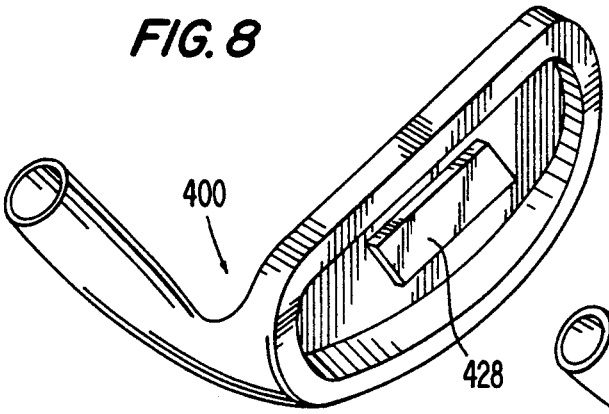
FIG. 8 is a rear perspective view of a fifth embodiment of the golf club head of the present invention.

FIG. 8 illustrates a fifth embodiment of a golf club head 400 of the present invention including a trapezoidal shaped mass 428 located within the cavity and having parallel opposite side walls.

Figure 9:
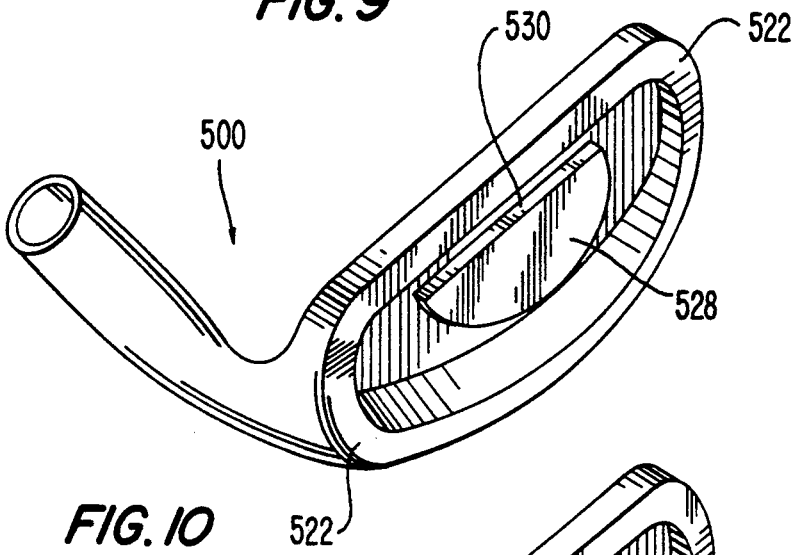
FIG. 9 is a rear perspective view of a sixth embodiment of the golf club head of the present invention.

FIG. 9 illustrates a sixth embodiment of a golf club head 500 of the present invention using an arcuate shaped mass 528 including a flat side 530 parallel to and spaced from the outer peripheral mass 522 of the club head 500.

Figure 10:
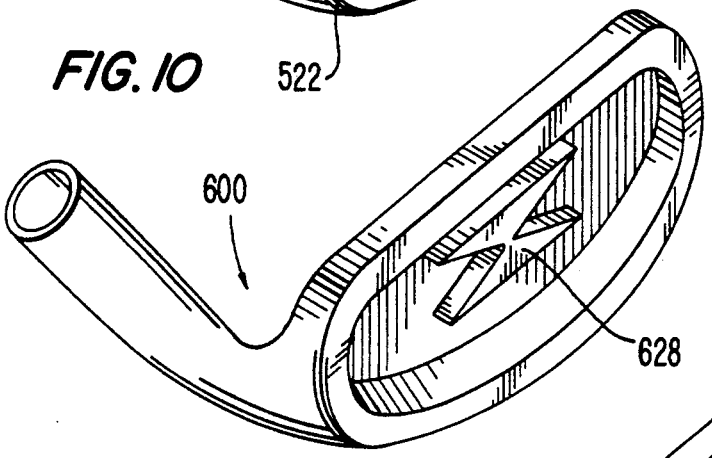
FIG. 10 is a rear perspective view of a seventh embodiment of the golf club head of the present invention.

FIG. 10 illustrates a seventh embodiment of a club head 600 of the present invention wherein the mass 628 is formed of a pair of raised triangles having adjacent or juxtaposed apex members. In this regard, it will be appreciated that the invention contemplates a plurality of similar shaped geometric masses disposed within the cavity and located behind the precise center of percussion (CP) on the club head.

Figure 11:
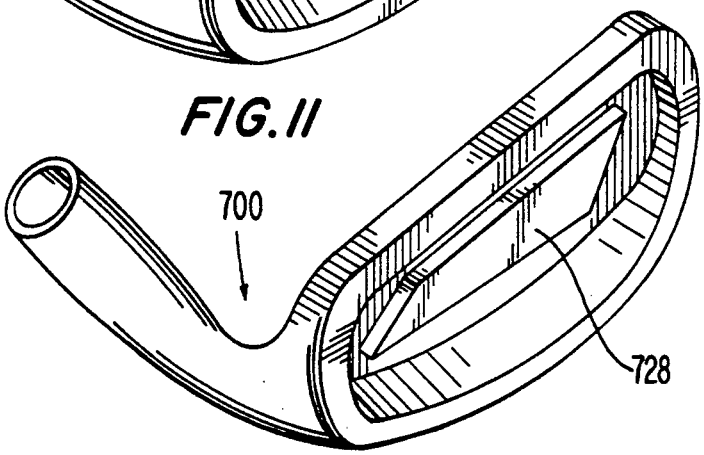
FIG. 11 is a rear perspective view of an eighth embodiment of the golf club head of the present invention.

FIG. 11 illustrates an eighth embodiment of a golf club head 700 of the present invention including a trapezoidal shaped mass 728 wherein none of the sides of trapezoid are parallel.

Figure 12:
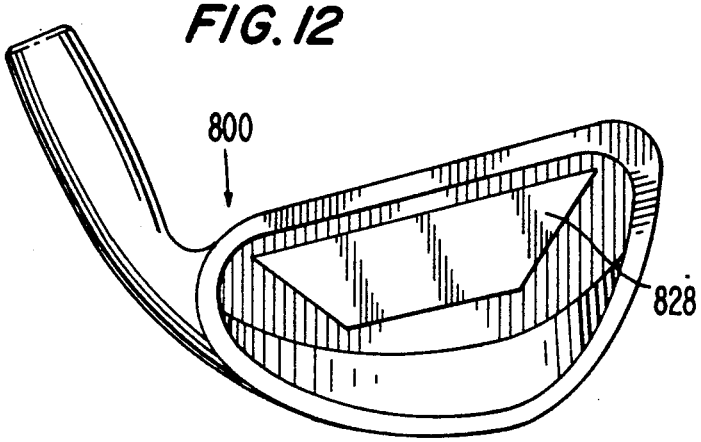
FIG. 12 is a rear elevational view of a ninth embodiment of the golf club head of the present invention.

FIG. 12 illustrates a ninth embodiment of a golf club head 800 of the present invention including a trapezoidal shaped mass 828 wherein the upper and lower bases are parallel to each other and the sides are disposed at complementary angles.

Figure 13:
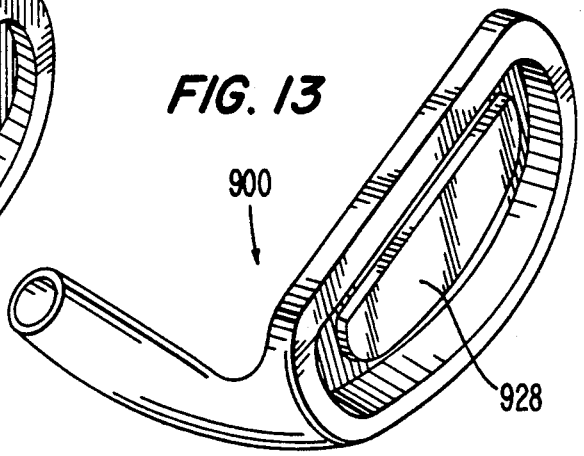
FIG. 13 is a rear perspective view of a tenth embodiment of the golf club head of the present invention.

FIG. 13 illustrates a tenth embodiment of a golf club head 900 of the present invention including a mass 928 which is centrally located within the cavity and covers substantially the entire cavity surface.

As shown in the drawings, each of the weight members shown in the drawings have side walls (see, e.g., wall 530 in FIG. 9) that extend from the rear face of the club head in the same direction as the side walls of the peripheral mass. In addition, the extremities of each of the weight members, as shown, are spaced radially about the center of percussion of the club head.

It will be appreciated that the improved golf club head has been described with respect to various specific embodiments of geometrically shaped center masses, but that changes and modifications may be made without departing from the spirit and scope of the invention as defined in the appended claims. For example, other embodiments are contemplated using a variety of shapes of masses within the cavity including polygons of various numbers of sides and regular and irregular geometric shapes such stars, cresents and/or other designs.

I claim:

1. A weighting system for an iron type golf club head having a loft angle of at least 12 degrees including a hosel, heel, toe, ball striking face, a center of percussion on said ball striking face, and a complementary rear face, the weighting system comprising:

a peripheral mass formed on the heel, toe, upper surface, and lower surface portions of the outer periphery or said rear face of the club head;

said peripheral mass defining a cavity located on said rear face of the club head and providing a perimeter weighting for the club head, said cavity having side walls extending outwardly from said complementary rear face; and a significant weight member formed completely within said cavity and spaced from said cavity side walls and located on said complementary rear race overlapping said center of percussion; said weight member being further characterized by a raised surface extending rearwardly from said rear face to at least substantial alignment with the rearmost surface of the upper surface portion of the peripheral mass.

2. The weighting system of claim 1 wherein said weight member has side walls that extend from said rear face in the same direction as the side walls of said peripheral mass.

3. The weighting system of claim 1 wherein the extremities of said weight member are spaced radially about said center of percussion.

4. The weight system of claim 1 wherein said weight member is square in shape.

5. The weight system of claim 1 wherein said weight member is octagon in shape.

6. The weight system of claim 1 wherein said weight member is triangular in shape.

7. The weight system of claim 1 wherein said weight member is diamond in shape.

8. The weight system of claim 1 wherein said weight member is a trapezoid having aligned sides and bases.

9. The weight system of claim 8 wherein said trapezoid is characterized by having non-aligned sides and bases.

10. The weight system of claim 1 wherein said weight member is arcuate in shape.

11. The weight system of claim 1 wherein said weight member is rectangular in shape.

12. The weight system of claim 1 wherein said weight member covers substantially the entire cavity surface.

13. The weight system of claim 1 wherein said weight member consists of a pair of oppositely disposed triangles.

14. A weighting system for an iron type golf club head having a loft angle of at least 12 degrees including a hosel, heel, toe, ball striking face, a center of percussion on said ball striking face, and a complementary rear face, the weighting system comprising:

a peripheral mass formed on the heel, toe, upper surface, and lower surface portions of the outer periphery of said rear face of the club head;

said peripheral mass defining a cavity located on said rear face of the club head and providing a perimeter weighting for the club head, said cavity having side walls extending outwardly from said complementary rear face; and a significant weight member formed completely within said cavity and spaced from said cavity side walls and located on said complementary rear face overlaying said center of percussion; said weight member being further characterized by a raised surface extending rearwardly from said rear face to at least substantial alignment with the rearmost surface of the upper surface portion of the peripheral mass; said weight member having side walls that extend from said rear face in the same direction as the side walls of said peripheral mass; and the extremities of said weight member being spaced radially about said center of percussion.

* * * * *

UNITED STATES PATENT AND TRADEMARK OFFICE
CERTIFICATE OF CORRECTION

PATENT NO. : 5,242,167

DATED : September 7, 1993

INVENTOR(S) : Anthony J. Antonious

It is certified that error appears in the above-identified patent and that said Letters Patent is hereby corrected as shown below:

On the Title page, item [54], line 1 before "CLUB" insert --GOLF--.

Claim 1, Column 4, line 20 change "or" to --of--.

Column 4, line 28, change "race" to --face--.

Column 4, line 29, change "overlapping" to --overlaying--.

Signed and Sealed this

Twenty-ninth Day of March, 1994

*Attest:*

*Attesting Officer*

BRUCE LEHMAN

*Commissioner of Patents and Trademarks*